US006719156B2

(12) United States Patent
Ellbogen et al.

(10) Patent No.: US 6,719,156 B2
(45) Date of Patent: Apr. 13, 2004

(54) MOUNTING CLIP FOR DRAPERY ROD

(75) Inventors: Ian Ellbogen, Montreal (CA); Howard Sirkin, Rosemere (CA)

(73) Assignee: Claire Fabrics (1996) Inc., Montreal (CA)

( * ) Notice: Subject to any disclaimer, the term of this patent is extended or adjusted under 35 U.S.C. 154(b) by 203 days.

(21) Appl. No.: 09/918,448

(22) Filed: Aug. 1, 2001

(65) Prior Publication Data

US 2003/0024893 A1 Feb. 6, 2003

(51) Int. Cl.[7] ..... A47F 5/00

(52) U.S. Cl. ..... 211/105.1; 211/123; 248/151; 248/161

(58) Field of Search ..... 211/105.1–105.6, 211/124, 123, 182, 204; 248/214, 251, 261, 254, 255, 262–264, 229.1, 229.15, 229.17, 229.2, 229.25, 229.26, 229.16; 403/230, 233, 234, 256, 232.1, 237, 241; 16/87 R, 87.2; 160/333, 340, 368.1, 127

(56) References Cited

U.S. PATENT DOCUMENTS

| | | | | | |
|---|---|---|---|---|---|
| 1,096,282 | A | * | 5/1914 | Boehm | 248/251 |
| 1,658,815 | A | | 2/1928 | Oskamp | |
| 1,790,258 | A | | 1/1931 | Boye | |
| 2,386,854 | A | | 10/1945 | Hilton | |
| 2,459,503 | A | | 1/1949 | Dahlstrom et al. | |
| 2,508,737 | A | | 5/1950 | Zeto | |
| 2,927,762 | A | | 3/1960 | Owsiak | |
| 3,001,000 | A | * | 9/1961 | Wantz, Jr. | 174/71 R |
| 3,233,856 | A | * | 2/1966 | Ammerman | 248/229.26 |
| 3,284,844 | A | * | 11/1966 | Seckerson | 16/259 |
| 3,889,912 | A | | 6/1975 | Ray | |
| 4,211,380 | A | * | 7/1980 | Lillegard et al. | 248/229.15 |
| 4,253,224 | A | * | 3/1981 | Hickman et al. | 29/890.148 |
| 4,316,547 | A | * | 2/1982 | Varon | 211/105.1 |
| 4,381,123 | A | * | 4/1983 | Anderson | 296/43 |
| 4,474,299 | A | * | 10/1984 | Andrews | 211/193 |
| 4,624,374 | A | * | 11/1986 | Murtaugh | 211/60.1 |
| 4,671,556 | A | * | 6/1987 | Lynas, III | 296/37.1 |
| 5,076,446 | A | * | 12/1991 | Simmerman et al. | 211/113 |
| 5,303,832 | A | * | 4/1994 | Tu | 211/105.4 |
| 5,415,299 | A | * | 5/1995 | Usner | 211/105.1 |
| 5,429,330 | A | * | 7/1995 | Bond et al. | 248/61 |
| 5,447,244 | A | * | 9/1995 | Mentzer | 211/123 |
| 5,716,155 | A | * | 2/1998 | Yoshida et al. | 403/187 |
| 5,797,223 | A | * | 8/1998 | Shoup et al. | 52/204.1 |
| 6,216,889 | B1 | | 4/2001 | Chang | |
| 6,430,759 | B1 | * | 8/2002 | Beltran | 4/576.1 |
| 6,488,159 | B2 | * | 12/2002 | Shuen | 211/123 |
| 6,499,186 | B1 | * | 12/2002 | Arentsen | 16/87 R |
| 6,543,731 | B1 | * | 4/2003 | Mercier | 248/62 |

* cited by examiner

*Primary Examiner*—Jennifer E. Novosad
(74) *Attorney, Agent, or Firm*—Diller, Ramik & Wight

(57) ABSTRACT

A multiple drapery rod supporting structure, comprising mounting brackets having cantilevered posts extending from the wall, and rod mounting clips which have extending tongue portions which are engaged within the ends of the rod to provide support and have a clip portion which easily snaps onto the support mounting posts. The rod is therefore supported between the posts of the mounting brackets. Several rods are able to be simultaneously supported, and alternate rod mounting clips permit rear rods or blinds to be located below the level of the front rod, such that the tops of rear curtains or blinds are hidden from view from within the room.

24 Claims, 6 Drawing Sheets

MOUNTING CLIP FOR DRAPERY ROD

TECHNICAL FIELD

The present invention relates to drapery rods, and more specifically relates to mounting support structures for drapery rods and the like.

BACKGROUND OF THE INVENTION

Curtain and drape rod brackets capable of supporting two rods, in order to be able to provide a window covering having a translucent rear curtain and an opaque front drape for example, are well known in the art.

U.S. Pat. No. 6,216,889, 2001, Chang, for example, teaches a support bracket for two curtain rods which have a simple rod retention means. Chang discloses a rod support with retaining fixtures, located on cross members protruding from the wall, having sliding locating members which lock the rod within the retaining fixtures. The locating members have inclined inner slide slot surfaces and have a slight recess which mates with a groove in the fixture wing plates to allow the locating members to be clipped in place. This permits two rods, mounted one behind the other, to be easily secured to the support bracket.

Adjustable brackets for curtain rods shown in U.S. Pat. No. 2,927,762, 1960, Owsiak, and U.S. Pat. No. 1,790,258, 1931, Boye, similarly discloses support brackets for a plurality of curtain rods, but also having a simple adjustment for permanently spacing at least one of the rods in a predetermined arrangement and having a single adjustment for quickly altering the spacing of the rods when desired. While the Owsiak bracket permits the rods to be fixed with a desired spacing, the design itself limits the number of rods possible, and once installed, no further rods can easily added. The Boye bracket comprises a channel-shaped bracket arm with a drape rod support on its outer end. A clip-in curtain rod support disposed within the bracket arm allows an internal curtain to be supported at a fixed distance from the support wall. The distance of the outer drape rod can be varied, the adjustable mechanism comprising a clamp screw in the inner bracket arm and a slot in the outer bracket arm which receives the end of the drape rod.

Therefore, while many variations on support brackets for multiple drapery rods exist in the prior art, none address certain shortcomings of traditional drapery rod mounting attachments. Namely, the inability to easily add or remove additional rods when the bracket is installed on the wall, the inability to easily vary the spacing between multiple rods and between the rods and the wall, and the inability to mount additional rods at different heights from a primary rod without requiring additional support brackets.

SUMMARY OF THE INVENTION

It is an object of the present invention to provide an improved drapery rod support fixture assembly.

It is another object of the present invention to provide a drapery rod support fixture assembly capable of accepting a plurality of rods.

It is yet another object of the present invention to provide a drapery rod support fixture assembly which allows additional rods to be added and their spacing to be varied following installation of the support fixture.

It is a further object of the present invention to provide a drapery rod support fixture assembly which permits supporting multiple rods at various heights without requiring additional support fixtures.

Therefore, in accordance with the present invention, there is provided a rod supporting structure, comprising: at least a first tubular rod having an outer surface and having an inner surface defining at least hollow end portions; at least a first and second mounting bracket, each having a cantilevered post member fixed at a first end to a mounting surface and extending generally perpendicularly from said mounting surface; and at least two clip elements adapted to support the rod from the mounting brackets, each clip element comprising at least a horizontally extending coupling portion for forming a load bearing axial connection with the end portions of the rod, and a clip portion for frictional engagement with the post member while permitting horizontal displacement of said clip elements on said post member.

BRIEF DESCRIPTION OF THE DRAWINGS

Further features and advantages of the present invention will become apparent from the following detailed description, taken in combination with the appended drawings, in which.

DETAILED DESCRIPTION OF THE PREFERRED EMBODIMENT

Figure 1A:
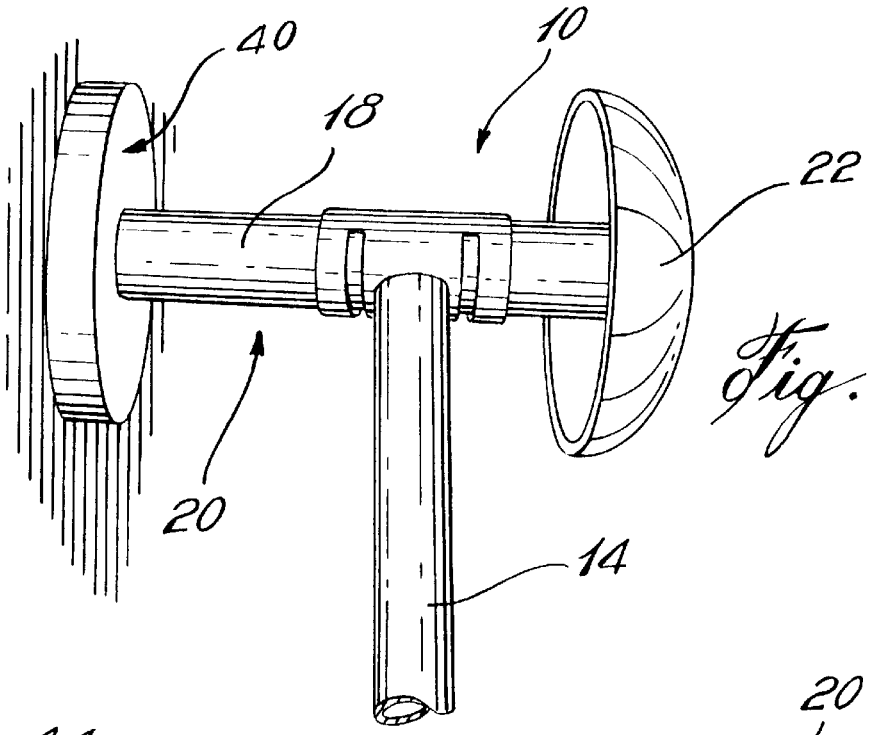
FIG. 1*a* is a top perspective view of the drapery rod support fixture assembly of a first embodiment of the present invention having only one rod.

Referring to FIG. 1*a* showing the most basic embodiment of the present invention, wherein an end mounting bracket element 20 supports a single drapery or curtain rod 14 which is fixed to the mounting bracket element 20 with a end clip element 10. All components of the present invention are preferably made of heat treated annealed spring steel, however other materials, including plastics, are equally possible.

Figure 1B:
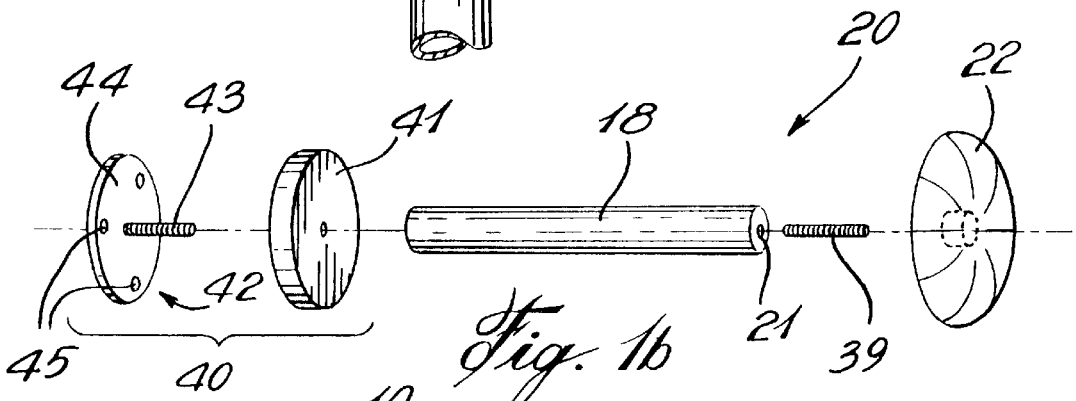
FIG. 1*b* is an exploded perspective view of the mounting bracket elements of the present invention.

The mounting bracket element 20 shown in FIG. 1*b* comprises a central post 18 which is fixed to a wall or window frame at a first end having a wall mounting attachment 40. The surface mounting attachment 40 comprises a base member 42 comprising a flat circular plate 44 having a centrally extending threaded pin 43 and mounting holes 45 for screwing the plate 44 to a wall or other mounting surface, and a disc cover 41 to conceal the base member 42. The post 18 has internal threaded holes 21 at either end, and is screwably engaged onto the threaded pin 43 of the surface mounting attachment 40. At the second remote end of the post 18 is a decorative rosette 22, or other end cap, which, while acting to prevent rod mounting clips on the post 18 from coming off, serves primarily as decoration to conceal the mounting bracket element 20 and the end clip element 10 which attaches to the drapery rod 14.

Figure 2A:
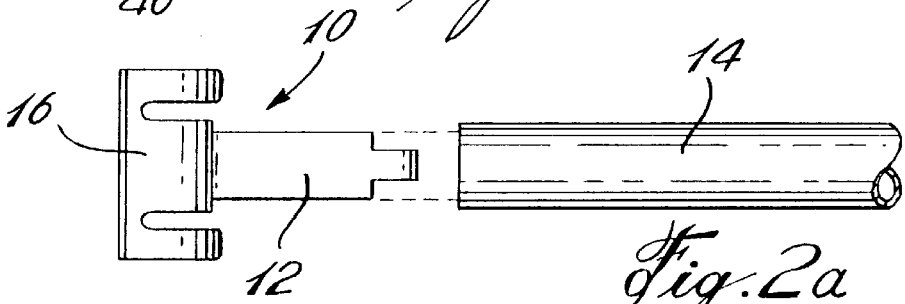
FIG. 2*a* is a top view of the support clip and rod of the present invention.
Figure 2B:
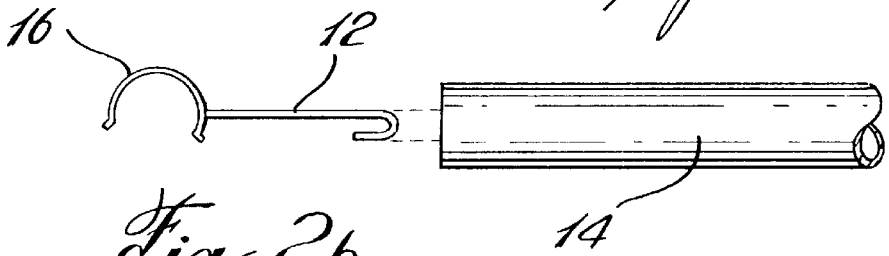
FIG. 2*b* is a side elevation view of a support clip and rod of the present invention.

FIGS. 2*a* and 2*b* show the end clip element 10 in more detail. A protruding coupling element, or tongue portion, 12 extends into the end of the drapery rod 14 and is frictionally retained within the hollow rod 14. A semicircular mounting clip 16 of the clip element 10, is dimensioned to clasp the post 18 of the mounting bracket element 20. The clip element 10, therefore, serves to vertically support the drapery rod 14 while still permitting forward and backward slidable displacement of the clip element 10 on the post 18 of the mounting bracket element 20, which permits varying the distance between the drapery rod and the mounting wall quickly and easily. Therefore, once installed, the distance of the drapery rod from the wall or window can be varied in situs, without requiring any unfastening and refastening of attachments.

Figure 9:
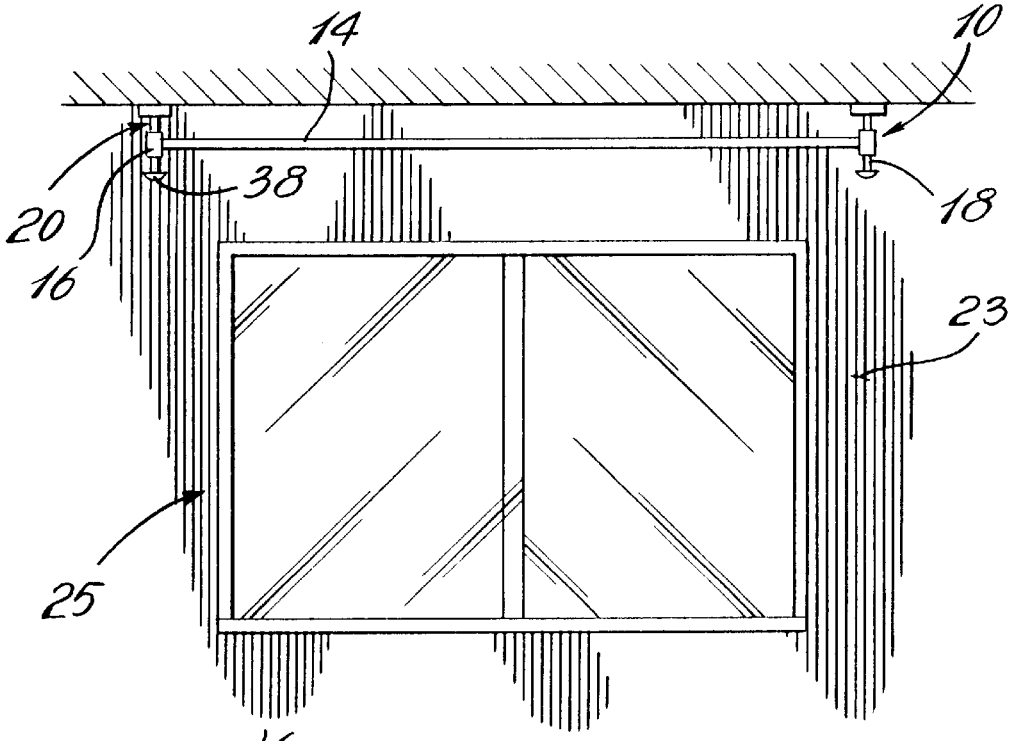
FIG. 9 is a front elevation view of an alternate embodiment showing the mounting bracket elements fastened to the ceiling.

In an alternative installation method as shown in FIG. 9, the mounting bracket elements 20 can be fastened to the ceiling, rather than the wall, above a window. The mounting clips 16 generally hold tightly enough to the post 18 of the mounting bracket elements 20 to support the rod and curtain, however should additional support be required, a post-end face plate 38, of larger diameter than the post 18, can replace the decorative rosettes 22 and be used to vertically support the rod if required.

Figure 3A:
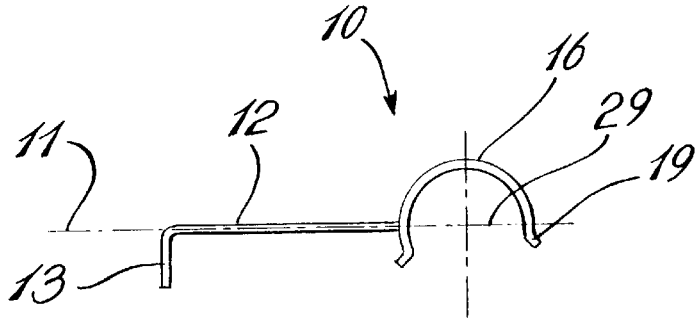
FIG. 3*a* is a side elevation view of an end support clip for a rod of the present invention.

FIG. 3*a* shows such an end clip element 10 for a primary drapery rod. The semicircular mounting clip 16 fits over and frictionally clasps the post 18, which has an axial vertical center line 29. The vertical center line of the extending tongue portion 12 is co-linear with the vertical center line 11 of the primary drapery rod 14. The vertical center lines 29 and 11 are therefore co-planar. The bent tip portion 13 of the tongue 12 helps to ease the mating engagement of the tongue into the drapery rod and quickly locates it in place. As the attachment system between the rods and their mounting brackets of the present invention does not require any fasteners, additional drapery rods can therefore be quickly and easily added to the mounting bracket elements 20. This, therefore, permits multiple drapery rods located one behind the other to be possible.

Additional drapery rods can quickly and easily be added or removed when the support brackets are installed in place on the wall, ceiling or window frame. This permits significant design and decoration flexibility as it permits curtains, drapes, or blinds to be added or removed from around the window without requiring moving, adding or removing the support mounting brackets.

Figure 3B:
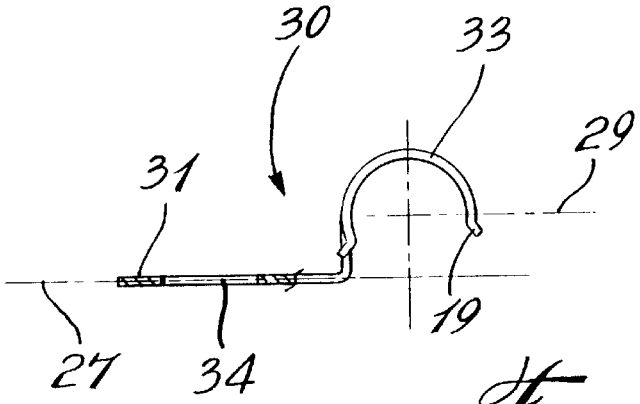
FIG. 3*b* is a side elevation, partly sectioned, view of an end support clip for additional rods or blinds of the present invention.
Figure 3C:
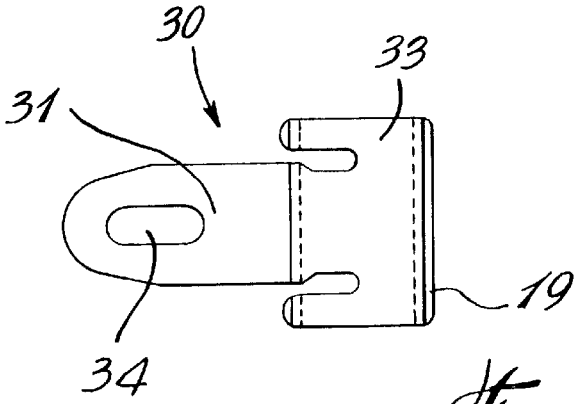
FIG. 3*c* is a top plan view of the rear end support clip shown in FIG. 3*b*.
Figure 7A:
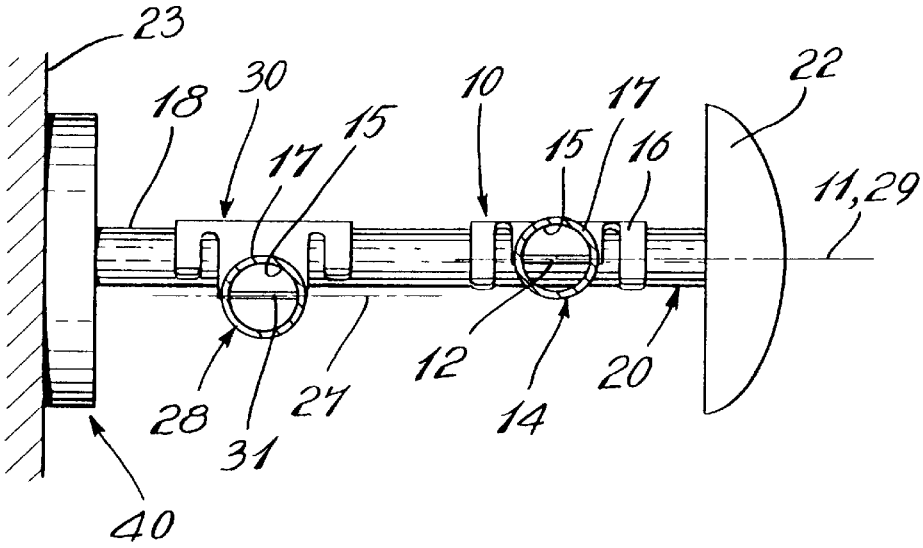
FIG. 7*a* is a vertical sectional view taken through line 7*a*—7*a* of the embodiment of the present invention shown in FIG. 6.

Additional rods mounted behind a front primary rod are often used to hang translucent curtains or vertical Venetian blinds behind a front drape, for example. For aesthetic reasons, traditionally mounted rear curtains or blinds are often attached separately to the wall to allow fixing them at a point below the front drape supports, such that the tops of the rear curtains or blinds are not visible from within the room. Therefore, in the present invention, a rear end clip element 30, shown in FIG. 3*b* and FIG. 3*c*, is used for additional rear rods or blinds in order to fix them at a point below the vertical center line of the front primary rod. As per the functionality of the front end clip element 10, a semicircular mounting clip 33 of the rear end clip 30 clasps the post 18, which has a vertical center line 29, of the mounting bracket element 20. Edges 19 of the semicircular mounting clip 33 are flared to permit an easier snap fit of the mounting clip 33 onto the post 18. All semicircular mounting clips are similarly flared. A tongue portion 31 of the clip element 30 extends from the clip at a point below the center vertical line 29 of the post 18. This creates a vertical center line 27 of rear rods 28 below that of the front rod, and which can be seen assembled in FIG. 7. This allows rear rods to be located below the front primary rod and therefore, improves the aesthetic appearance of drapes and curtains hung using the present invention.

Figure 7B:
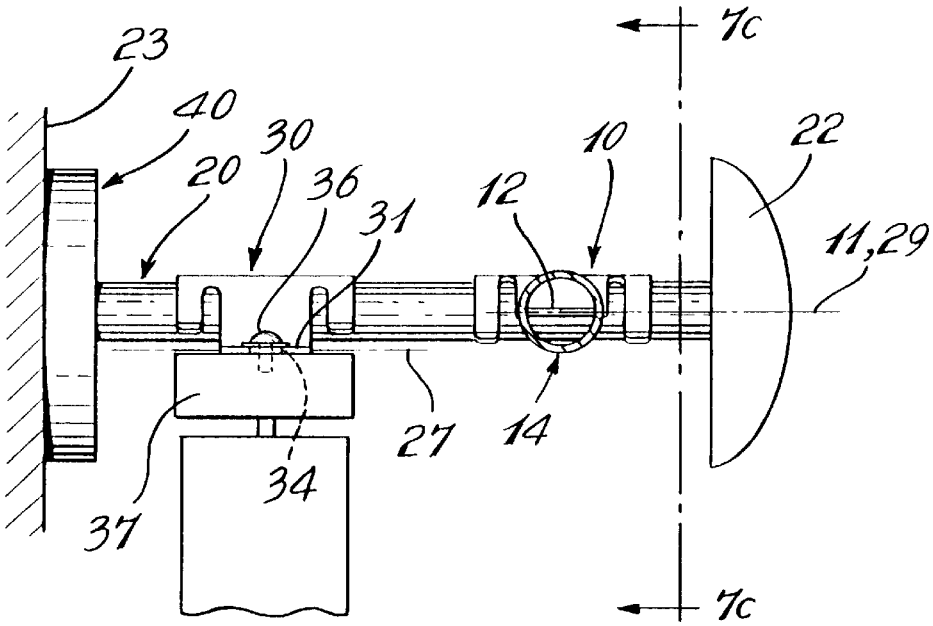
FIG. 7*b* is a vertical sectional view of an alternate embodiment, having blinds mounted behind a front primary rod.
Figure 7C:
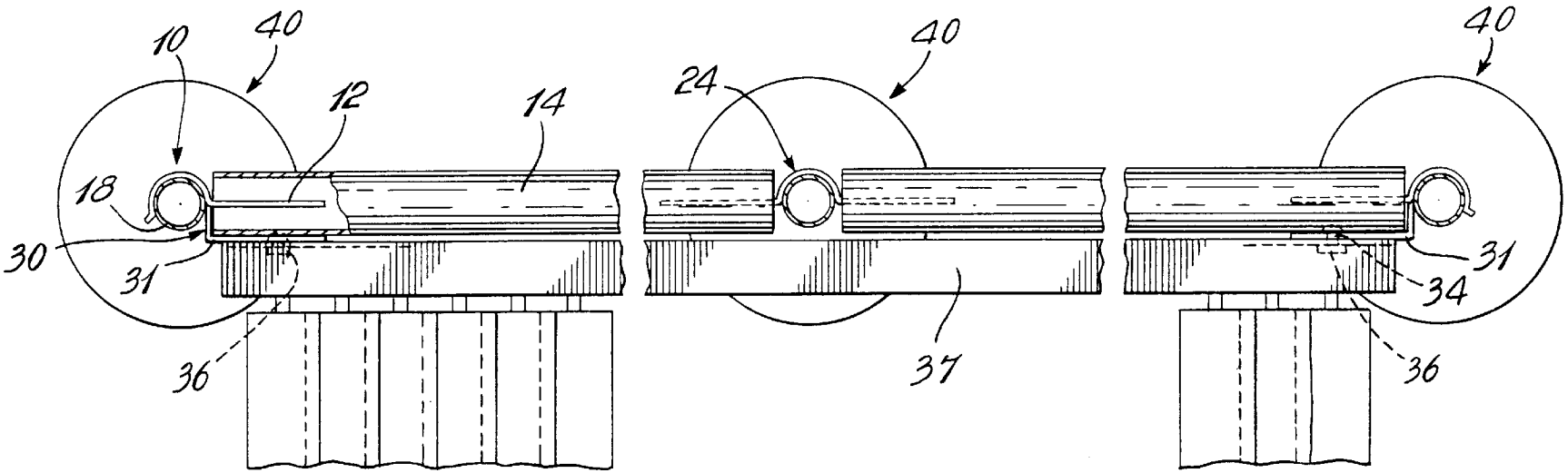
FIG. 7*c* is front vertical sectional view taken through line 7*c*—7*c* of the embodiment shown in FIG. 7*b*.

Blinds hung behind a front primary rod similarly use the rear end clip elements 30 such that they can be suspended lower than the front drape. A hole 34 in the tongue portion 31 of the clip element 30 provides a fastening point for attaching the top bracket 37 of blinds using a nut and bolt assembly 36, or other equivalent fastener. An advantage of using rear end clip elements 30 in this way, is that it permits blinds fastened to the clips to be installed across multiple supports. For example, a single rear blind can be fixed to mounting bracket elements 20 at either end of the window, even if a third middle mounting bracket element 20 is required to support the front primary rod. This is shown in FIGS. 7*b* and 7*c*.

Figure 4A:
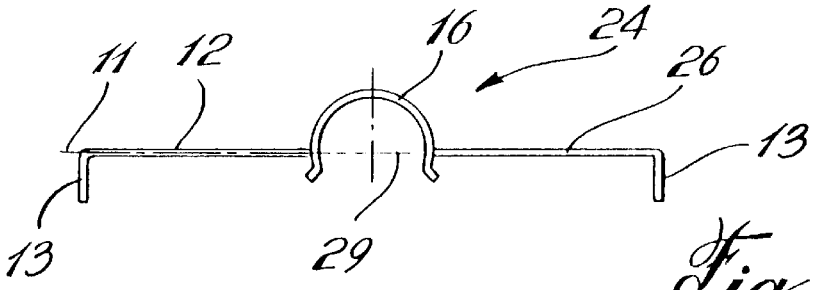
FIG. 4*a* is a side elevation view of an intermediate support clip for a rod of the present invention.

For large windows requiring long rods, additional support of the drapery rods may be necessary. As such, an additional center mounting bracket element 20 may be required between the two end mounting bracket elements 20. This, therefore, necessitates two sets of drapery rods on either side of the center mounting bracket element 20. Additionally, a modified clip element is required to support rods on either side of the central mounting bracket element. FIG. 4*a* shows such a 'butterfly' front middle clip element 24. The front middle clip element 24 is substantially similar to the front end clip element 10. However, it additionally comprises a second tongue 26 horizontally opposed to the first tongue portion 12. This permits the semicircular mounting clip 16 to frictionally grasp the post 18, and the tongue portions to be inserted into the ends of each drapery rod 14 on either side of the central mounting bracket element 20. For the front drapery rods, the rod elements 14 and the post 18 have a common vertical center line 29.

Figure 4B:
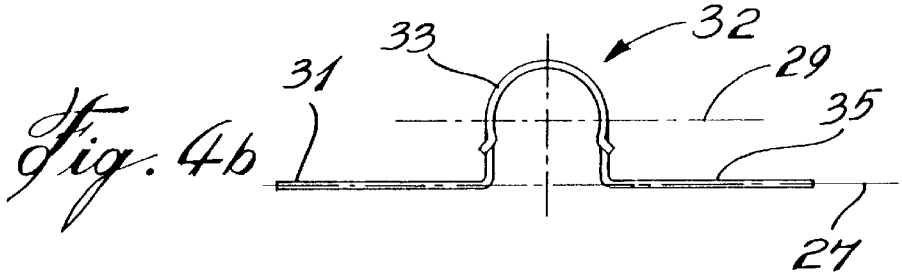
FIG. 4*b* is a side elevation view of an intermediate support clip for additional rods of the present invention.

The 'butterfly' rear middle clip element 32, shown in FIG. 4*b*, is intended to permit the rear rods 28 to be mounted below the front primary rods 14. The semicircular mounting clip 33 of the rear middle clip element 32 similarly clasps onto the post 18 of the middle mounting bracket element 20. The rear middle clip element 32 is substantially similar to the rear end clip 30, however, as per the front middle clip element 24, having a second tongue portion 35 horizontally opposed to the first tongue portion 31, therefore permitting the lower vertical center line 27 of the rear rods 28.

Figure 5:
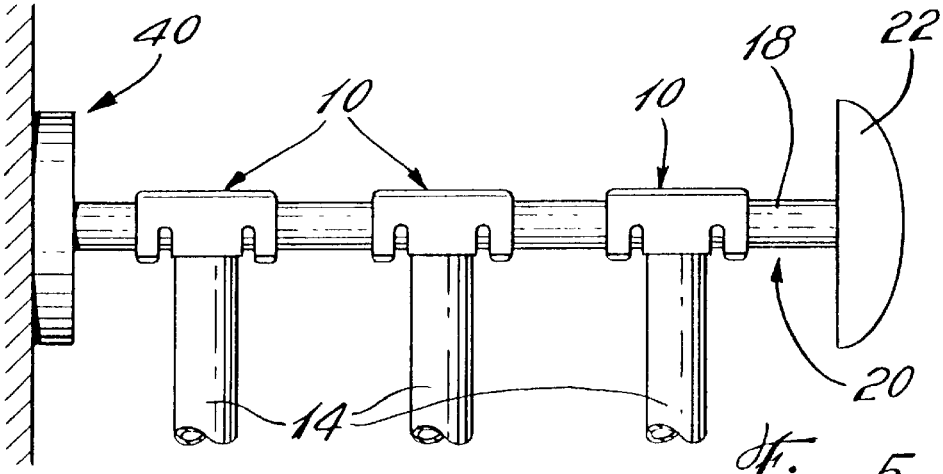
FIG. 5 is a top plan view of an embodiment of the present invention having a plurality of rods mounted using the drapery rod support fixture assembly.

FIG. 5 shows an embodiment of the present invention where three drapery rods are supported. Up to four individual rods can be supported using the present fixtures. While FIG. 5 shows three front drapery rods 14, and therefore three rods at the same elevation, any combination of front and rear drapery rods and blinds at any combination of heights, can be used.

Figure 6:
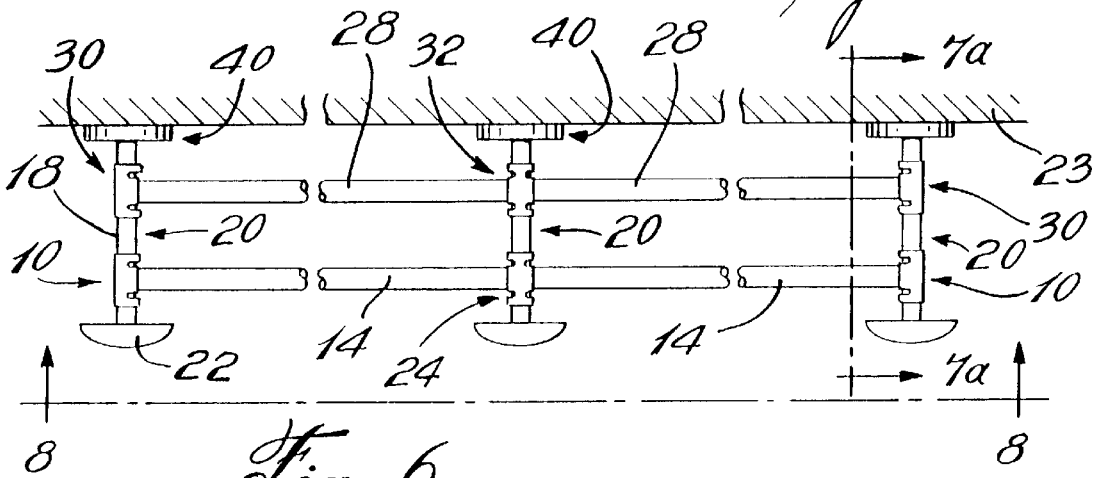
FIG. 6 is a top plan view of another embodiment of the present invention, wherein two rods are mounted using a drapery rod support fixture assembly having a rear rod fixed lower than the front primary rod.

FIG. 6 shows a top view of an assembly having front and rear rods and a central mounting bracket element 20. The mounting bracket elements are fixed to the mounting surface 23. The two end mounting brackets support the front and rear clip elements 10 and 30 respectively which clip to the posts 18 of the mounting brackets. The two front primary drapery rods 14 have a vertical center line 11 common with the vertical center line 29 of the posts 18. The lower rear rods 28, supported at either end by the two rear end clips 30 and in the center by the rear middle clip 32, have a vertical center line 27 below that of the front drapery rods 14 and the support posts 18. This height difference between the front rods 14 and the rear rods 28, can be readily seen in FIG. 7*a*. While a height difference of about half a rod diameter is shown, it is to be understood that any elevation difference between rods is possible, and dependant only on the form of the rod mounting clips. The tongue portions 12 and 31 of the front and rear end clips 10 and 30 respectively, can be dimensioned for the size of rod required for any particular application such that they are retained within the rods by frictional engagement with the interior circumferential surface 15 of the rods.

Figure 8:
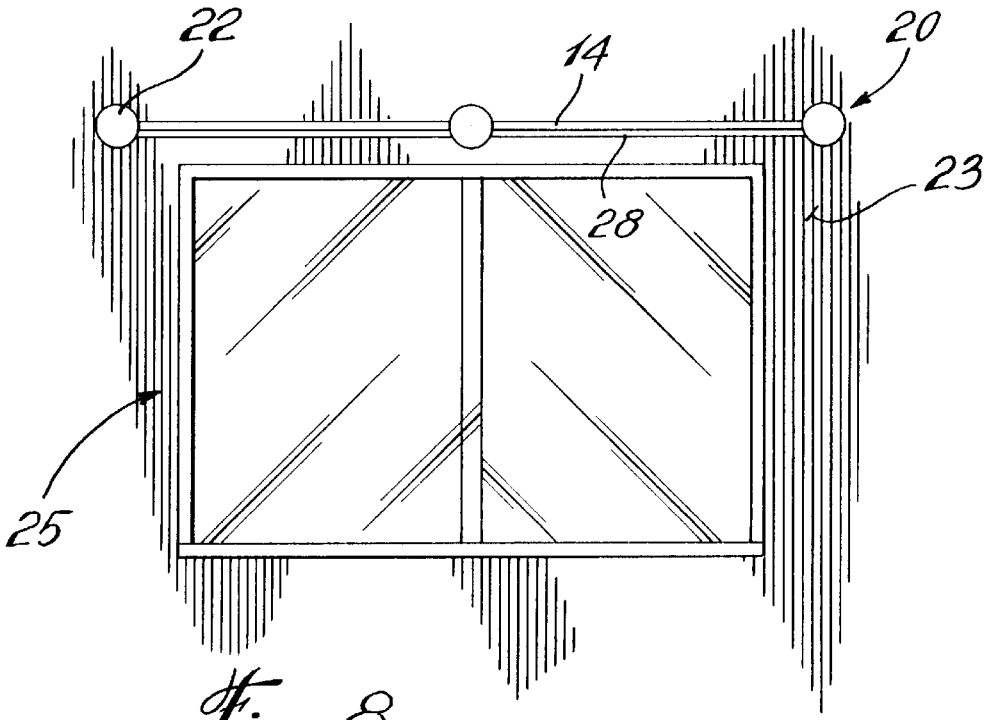
FIG. 8 is front elevation view of the embodiment of the present invention shown in FIG. 6.

FIG. 8 shows the front view of an embodiment as shown in FIG. 6 having two rods, a front primary drapery rod 14 and a lower rear rod 28. Decorative rosettes 22 hide the mounting bracket elements 20 and the rod mounting clips. The assembly is shown, as an example, fixed to a wall 23 above a window 25. However, the mounting bracket elements 20 can equally be fixed a window frame or to surrounding decoration.

The embodiments of the invention described above are intended to be exemplary only. The scope of the invention is therefore intended to be limited solely by the scope of the appended claims.

We claim:

1. A rod supporting structure, comprising:

at least a first tubular rod for supporting a window covering therefrom having an outer surface and having an inner surface defining an aperture in at least each end of said rod;

at least a first and second mounting bracket, each having a post member adapted to be fixed at a first end to a mounting surface and extending generally perpendicularly from said mounting surface; and at least one clip element for engaging each said end of said rod to said mounting brackets, each clip element comprising at least one coupling member for load bearing axial engagement with said ends of said rod, and a clip portion frictionally retained in place at any position along said post member and being adjustable therealong while bearing a load.

2. The rod supporting structure as defined in claim 1, wherein each mounting bracket comprises a base plate screwably fastened to said mounting surface and having a perpendicularly protruding threaded pin, a cover for said base plate, said post member threadably engaged at said first end with said threaded pin, and a decorative element threadably engaged at a second remote end with said post member.

3. The rod supporting structure as defined in claim 1, wherein said coupling member comprises an extending tongue portion adapted for mating engagement within said apertures in said ends of said rod.

4. The rod supporting structure as defined in claim 3, wherein said tongue portion is retained within said rod by frictional engagement with said inner surface.

5. The rod supporting structure as defined in claim 3, wherein said tongue portion extends from said clip portion at a point located below a vertical centerline of said first rod.

6. The rod supporting structure as defined in claim 1, wherein said post member is cantilevered from said mounting surface.

7. The rod supporting structure as defined in claim 6, wherein said clip portion permits horizontal displacement on said post member.

8. The rod supporting structure as defined in claim 1, wherein said rod is made up of two rod sections supported between said first and second mounting brackets by a third mounting bracket adapted to be fixed to said mounting surface, said third mounting bracket being located between said first and second mounting brackets, and a third clip element frictionally engaged with a post member of said third mounting bracket and having two horizontally opposed and protruding coupling members for engaging adjacent ends of said two rod sections.

9. The rod supporting structure as defined in claim 1, wherein at least a second rod is supported by a pair of clip elements, each engaged to the post members of the mounting brackets.

10. The rod supporting structure as defined in claim 9, wherein the second rod is at a different height than said first rod.

11. The rod supporting structure as defined in claim 1, wherein at least one blind is supported by a pair of clip elements, each engaged on the post members of the mounting brackets.

12. The rod supporting structure as defined in claim 11, wherein the at least one blind is at a different height than said rod.

13. The rod supporting structure as defined in claim 1, wherein said clip portion is biased in a post gripping position such that said clip portion clamps onto said post member.

14. The rod supporting structure as defined in claim 13, wherein said clip portion is an elastically deflectable clamp.

15. A rod supporting structure, comprising:

a first and at least a second tubular rod, each rod having an outer surface and an inner surface defining an aperture in at least each end of said rod;

two end mounting brackets, each having a cantilevered post member, adapted to be fixed at a first end to a mounting surface and extending perpendicularly from said mounting surface;

at least one clip element supporting each said end of said rods from said mounting brackets, each said clip element comprising at least one coupling member for load bearing axial engagement with said ends of said rods, and a clip portion frictionally retained in place at any position along said post member and being adjustable therealong while bearing a load; and said second rod being located below the first rod.

16. The rod supporting structure as defined in claim 15, wherein at least one of said first and second rods comprises two rod sections, each of said two rod sections being supported at a first end by one of said two end mounting brackets and at a second end by a third mounting bracket adapted to be fixed to said mounting surface and located between said two end mounting brackets.

17. The rod supporting structure as defined in claim 15, wherein said at least one coupling member is frictionally engaged with said ends of said rods.

18. The rod supporting structure as defined in claim 17, wherein said coupling member comprises an extending tongue portion adapted for mating engagement with said ends of said rods.

19. The rod supporting structure as defined in claim 18, wherein said tongue portion is retained within said rod by frictional engagement with said inner surface.

20. The rod supporting structure as defined in claim 15, wherein each mounting bracket comprises a base plate screwably fastened to said mounting surface and having a perpendicularly projecting central threaded pin, a cover for said base plate, said post member threadably engaged at said first end with said threaded pin, and a decorative element threadably engaged at a second remote end with said post member.

21. A rod supporting structure, comprising:

at least a first tubular rod having an outer surface and having an inner surface defining an aperture in at least each end of said rod;

at least a first blind assembly comprising a plurality of individual slats supported from an elongated top mounting bracket;

at least a first and second mounting bracket, each having a post member adapted to be fixed at a first end to a mounting surface and extending generally perpendicularly from said mounting surface;

at least one clip element for engaging each end of said rod to said mounting brackets, each clip element comprising at least one coupling member for load bearing axial engagement with said ends of said rod, and a clip portion frictionally retained in place at any position along said post member and being adjustable therealong while bearing a load; and at least one clip element for engaging each end of said blind assembly to said mounting brackets, each clip element comprising at least one coupling member for load bearing engagement with said top mounting bracket of said blind assembly, and a clip portion frictionally retained in place at any position along said post member and being adjustable therealong while bearing a load.

22. The rod supporting structure as defined in claim 21, wherein said blind assembly is supported by said clip element at a different height than said first rod.

23. The rod supporting structure as defined in claim 21, wherein said rod is made up of two rod sections supported between said first and second mounting brackets by a third mounting bracket adapted to be fixed to said mounting surface, said third mounting bracket located between said first and second mounting brackets, and a third clip element frictionally engaged with a post member of said third mounting bracket and having two opposed and protruding coupling members for engaging adjacent ends of said two rod sections.

24. The rod supporting structure as defined in claim 23, wherein said blind assembly is located below said first rod, and supported at each end thereof by said first and second mounting brackets.

* * * * *